US007871182B2

(12) United States Patent
Daffin, III

(10) Patent No.: US 7,871,182 B2
(45) Date of Patent: Jan. 18, 2011

(54) REFLECTIVE LIGHT BULB COVER FOR RECESSED LIGHTING

(75) Inventor: Charles Ernest Daffin, III, 5018 Bradfordville Rd., Tallahassee, FL (US) 32309

(73) Assignee: Charles Ernest Daffin, III, Tallahassee, FL (US)

( * ) Notice: Subject to any disclaimer, the term of this patent is extended or adjusted under 35 U.S.C. 154(b) by 185 days.

(21) Appl. No.: 12/152,358

(22) Filed: May 15, 2008

(65) Prior Publication Data

US 2009/0284977 A1 Nov. 19, 2009

(51) Int. Cl.
*F21V 3/00* (2006.01)

(52) U.S. Cl. ..... 362/255; 362/311.01; 362/294; 362/363

(58) Field of Classification Search ..... 362/310, 362/16–18, 363–364, 329, 351–361, 255, 362/256, 311.01, 294, 373
See application file for complete search history.

(56) References Cited

U.S. PATENT DOCUMENTS

| | | | | | |
|---|---|---|---|---|---|
| 2,326,004 | A | * | 8/1943 | Barrett | 359/359 |
| 3,692,977 | A | * | 9/1972 | Duhamel et al. | 392/347 |
| 4,293,899 | A | * | 10/1981 | Sanner | 362/294 |
| 4,930,054 | A | * | 5/1990 | Krebs | 362/149 |
| 5,174,646 | A | * | 12/1992 | Siminovitch et al. | 362/218 |

* cited by examiner

*Primary Examiner*—Thomas M Sember

(57) ABSTRACT

A light bulb cover for use with a recessed lighting fixture consisting of a rigid glass envelope having the outer shape of a flood light and mounting hardware for securing the glass envelope to a light bulb.

2 Claims, 4 Drawing Sheets

REFLECTIVE LIGHT BULB COVER FOR RECESSED LIGHTING

FIELD OF THE INVENTION

The present invention relates to light bulbs and, more particularly, to a cover for conventional light bulbs to be used in recessed lightning.

BACKGROUND OF THE INVENTION

Recess lighting in homes and commercial buildings requires a a special light bulb. A recess ceiling can require an indoor flood or spot bulb that has a large enough globe base to completely fill the opening space therein. The problem is that these special bulbs are very expensive compared to regular light bulbs. An incandescent recess bulb costs approximately $5. A fluorescent recess bulb costs $10. Regular incandescent light bulbs cost 50 cents. Some fluorescent bulbs cost $2 instead of $10. Regular economical bulbs will fit into the recess can but have a bad appearance because they do not fill out the recess can opening. Also the regular bulb, if inserted into the recess can, will not reflect the light down out of the can efficiently.

There needs to be a way to use the inexpensive bulbs in recess light cans.

It would be advantageous to provide a way to use the regular inexpensive light bulbs in recess light cans that require more expensive bulbs.

It would also be advantageous to provide a cover for inexpensive bulb that would make them look and function just like more expensive bulbs.

It would further be advantageous to provide a cover that can be reused over and over again.

SUMMARY OF THE INVENTION

In accordance with the present invention, there is provided a cover that attaches to the bulb itself and will fill the trim hole for appearance and also reflect light down out of the recess can.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
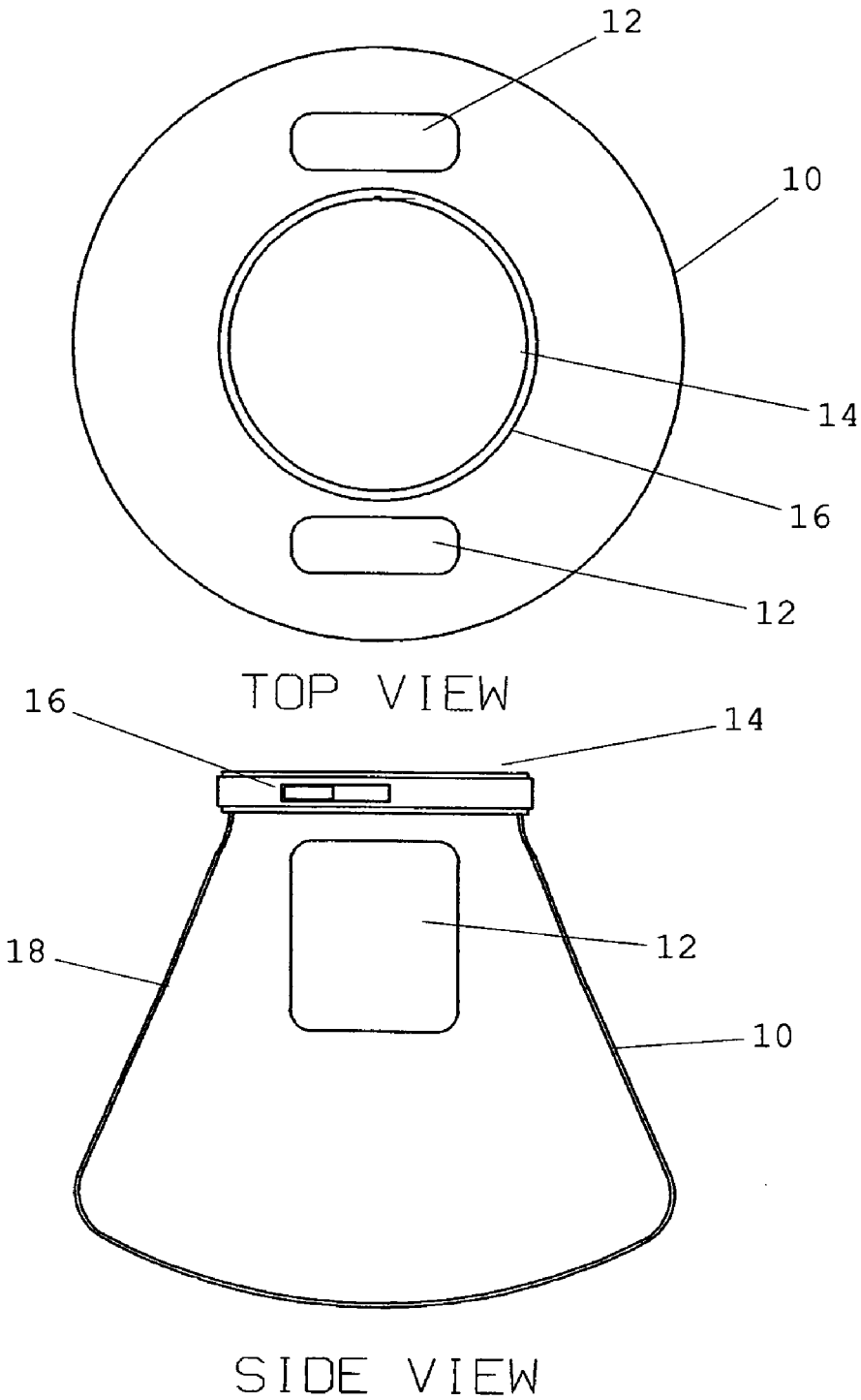
FIG. 1 is a plan view of a "light bulb cover"

FIG. 1 is a plan view of a "light bulb cover ". A glass or synthetic material 18 has the shape of the intended light bulb for a recess can fixture A gripping ring 14 is made with a fireproof heat resistant griping material that allows a locking attachment ring 16, camlock, velcro, screw or threaded system to attach the "light bulb cover 10" to a standard light bulb. The light bulb cover 10 also has a reflective coating on the sides 18 in order to reflect light down out of the recess can. Air holes 12 are provided for ventilation.

Figure 2:
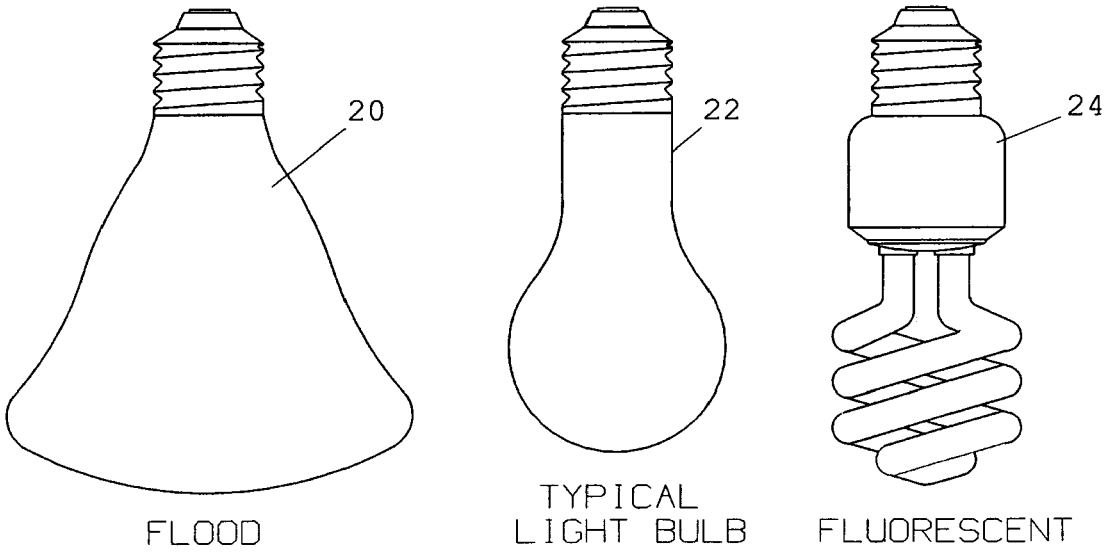
FIG. 2 is an elevation view of a light bulb.

FIG. 2 is an elevation view of light bulbs. A flood light 20 is made for use in a recess ceiling can 26 (FIG.3) and is very expensive $5-$10. A typical incandescent bulb 22 cost 50 cents but is not shaped to be used in a recess can fixture. A typical fluorescent bulb 24 costs about $2 but is also not shaped to be used in a recess fixture. None of theses bulbs 22, 24 reflects light down out of the recess can efficiently.

Figure 3:
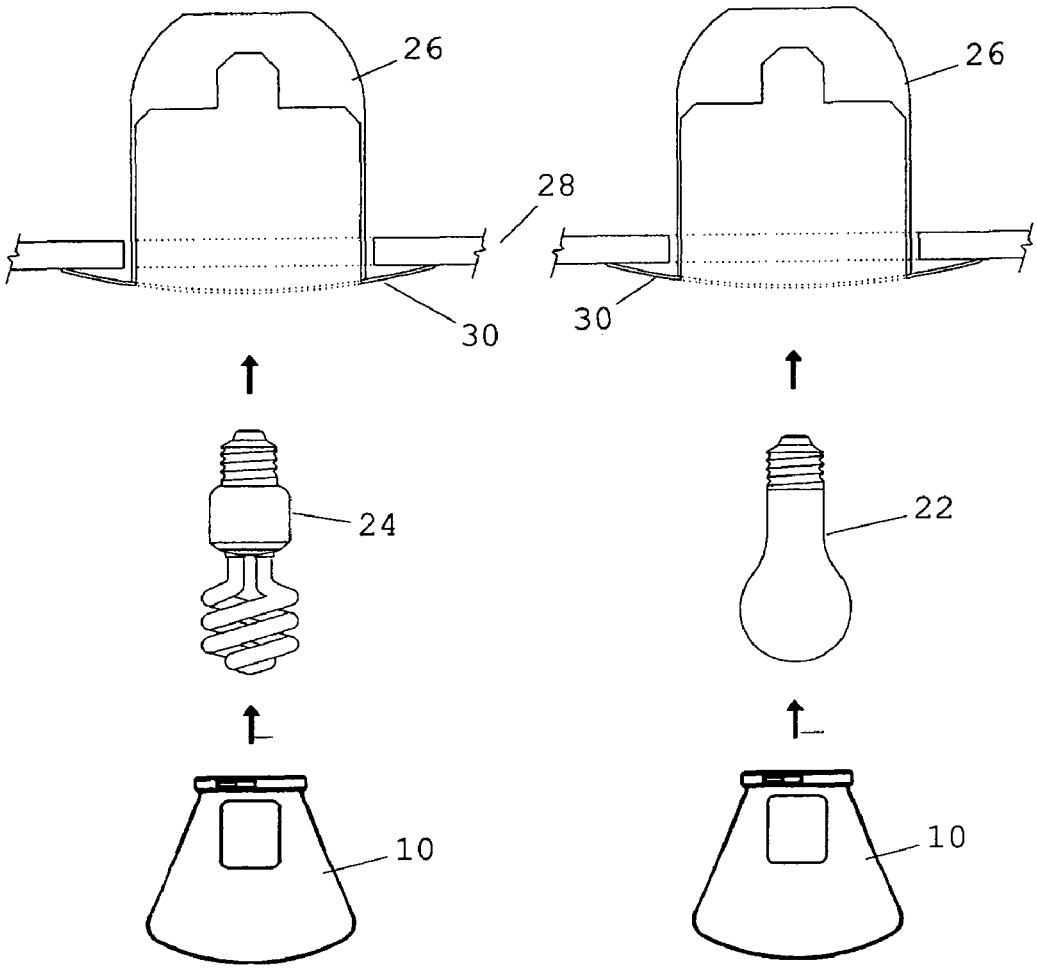
FIG. 3 is an elevation view of a "light bulb cover" to be inserted over a bulb and placed into a recess can.

FIG. 3 is an elevation view of the "light bulb cover 10" to be inserted over a bulb and placed into a recess can. The "light bulb cover 10" is attached to the standard light bulb then installed into a recess rough-in can 26. Note that the "light bulb cover 10" can be reused whenever a light bulb 22, 24 is replaced.

Figure 4:
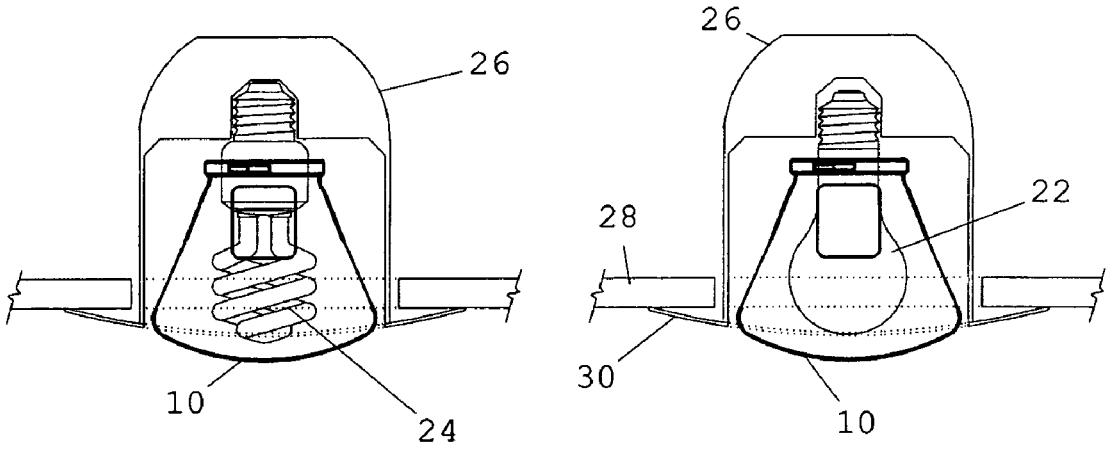
FIG. 4 is an elevation view of a "light bulb cover" on the bulb and inserted in a recess can.

FIG. 4 is an elevation view of the "light bulb cover 10" on bulbs 22, 24, and in place in recess ceiling cans 26.

Thus in summary, it can be seen that what is provided in this invention is a light bulb cover 10 that is functional, simple, inexpensive and decorative, shaped to fit ceiling recess cans 26 and trims in a ceiling 28, and that has a simple attachment to any inexpensive, light bulb. Such bulbs can be used in a recess ceiling can fixture instead of the much more expensive bulbs that are made for recess light fixtures. The "light bulb cover 10" has the same look and function as the expensive flood bulbs. The "light bulb cover 10" can also be used as a stand alone protective cover for light bulbs if not used in a recess can fixture.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A light bulb cover for use with a recessed lighting fixture comprising:

a rigid glass envelope having an outer shape of a flood light for use in the recessed lighting fixture;

mounting hardware for securing said glass envelope to a light bulb and said recessed lighting fixture;

said envelope including open air holes for letting air flow in and out of said rigid glass envelope;

a heat resistant rigid gripping ring for gripping said light bulb and attaching said rigid glass envelope thereto; and a fastener locking attachment, for securely locking said rigid glass envelope to said light bulb and rigidly connected to said rigid gripping ring.

2. The light bulb cover for use with a recessed lighting fixture as recited in claim 1 further comprising:

said rigid glass envelope further including a reflective coating on a surface thereof.

* * * * *